US010920411B2

(12) United States Patent
Lin et al.

(10) Patent No.: US 10,920,411 B2
(45) Date of Patent: Feb. 16, 2021

(54) HAIR CUTTING ASSEMBLY AND RELATED FLOOR DRAIN

(71) Applicant: JOMOO KITCHEN & BATH CO., LTD., Fujian (CN)

(72) Inventors: Xiaofa Lin, Fujian (CN); Xiaoshan Lin, Fujian (CN); Kunpeng Huang, Fujian (CN); Yaoting Qi, Fujian (CN); Haokuan Chen, Fujian (CN)

(73) Assignee: JOMOO KITCHEN & BATH CO., LTD., Fujian (CN)

( * ) Notice: Subject to any disclaimer, the term of this patent is extended or adjusted under 35 U.S.C. 154(b) by 93 days.

(21) Appl. No.: 16/286,608

(22) Filed: Feb. 27, 2019

(65) Prior Publication Data

US 2019/0277015 A1 Sep. 12, 2019

(30) Foreign Application Priority Data

Mar. 6, 2018 (CN) ..... 2018 1 0182189

(51) Int. Cl.

| | |
|---|---|
| ***E03F 5/04*** | (2006.01) |
| ***B02C 18/14*** | (2006.01) |
| ***B02C 18/00*** | (2006.01) |
| ***B02C 23/36*** | (2006.01) |
| ***E03C 1/266*** | (2006.01) |

(52) U.S. Cl.

CPC ..... *E03F 5/041* (2013.01); *B02C 18/0092* (2013.01); *B02C 18/142* (2013.01); *B02C 18/146* (2013.01); *B02C 23/36* (2013.01); *E03C 1/2665* (2013.01); *E03F 5/0407* (2013.01); *B02C 2201/063* (2013.01)

(58) Field of Classification Search

CPC ..... E03C 1/266; E03C 1/2665; E03F 5/0407; E03F 5/041; B02C 18/0092; B02C 18/142; B02C 18/146; B02C 23/36; B02C 2201/06; B02C 2201/063

USPC .... 210/163, 164, 172; 241/36, 46.01, 46.06, 241/46.15

See application file for complete search history.

(56) References Cited

U.S. PATENT DOCUMENTS 3,048,340 A * 8/1962 Vernon ..... E03C 1/2665 241/46.06

3,108,754 A * 10/1963 Low ..... E03C 1/2665 241/36

(Continued)

FOREIGN PATENT DOCUMENTS

| | | |
|---|---|---|
| CN | 205990661 | 3/2017 |
| CN | 107345422 | 11/2017 |

*Primary Examiner* — Christopher Upton

(74) *Attorney, Agent, or Firm* — JCIPRNET

(57) ABSTRACT

Provided is a hair cutting assembly. The hair cutting assembly includes at least one first shearing wheel, first transmission shaft that drives the first shearing wheel to rotate, at least one second shearing wheel and second transmission shaft that drives the second shearing wheel to rotate. Opposite end surfaces of each first shearing wheel and the corresponding second shearing wheel are attached to each other. The first cutting blades, formed by intersecting end surface of the first shearing wheel with side wall, and the second cutting blades, formed by intersecting end surface of the second shearing wheel with side wall, oppositely move in a feed direction, such that long and thin linear sundries such as hairs and fabrics can be continuously shorn. A floor drain with the hair cutting assembly is also provided.

15 Claims, 18 Drawing Sheets

(56) References Cited

U.S. PATENT DOCUMENTS

| | | | | | |
|---|---|---|---|---|---|
| 3,880,361 | A * | 4/1975 | Schwarz | B02C 18/142 | 241/36 |
| 4,034,422 | A * | 7/1977 | Farber | E03C 1/2665 | 241/36 |
| 4,411,391 | A * | 10/1983 | Crane | B02C 18/142 | 241/232 |
| 5,516,050 | A * | 5/1996 | Yamamoto | B02C 18/142 | 241/236 |
| 8,919,682 | B2 * | 12/2014 | Lee | C05F 17/90 | 241/46.06 |
| 2004/0140383 | A1 * | 7/2004 | Chang | B02C 18/142 | 241/236 |
| 2005/0040263 | A1 * | 2/2005 | Parke | B02C 18/142 | 241/30 |
| 2010/0133370 | A1 * | 6/2010 | Flynn | B02C 18/0092 | 241/46.01 |
| 2017/0080434 | A1 * | 3/2017 | Shi | B02C 18/142 | |

* cited by examiner

HAIR CUTTING ASSEMBLY AND RELATED FLOOR DRAIN

CROSS-REFERENCE TO RELATED APPLICATION

The present application is based upon and claims the benefit of priority from CN application No. 201810182189.9, filed on Mar. 6, 2018, the disclosure of the CN application is incorporated herein in its entirety by reference.

BACKGROUND OF THE INVENTION

1. Field of the Invention

The present invention relates to a hair cutting assembly used for a floor drain, in particular to a hair cutting assembly and a related floor drain.

2. Description of Related Art

After entering a drainage pipe, long and thin linear sundries such as hairs and fabrics which are impacted by water flow in the pipe are easily intertwined, and then are gathered together to block the drainage pipe, and thus, a drainage system fails. A grate for stopping foreign matters such as hairs and fabrics from entering the drainage pipe is generally arranged at an inlet, namely the position of a floor drain, of an existing drainage system. However, only using the grate cannot completely stop the long and thin sundries from entering the drainage pipe, and the pipe may still be blocked possibly.

Therefore, the applicant devotes himself to research and develop a related solution all the time, in Chinese patent application No. 201710596430.8 published on Nov. 14, 2017, a technical scheme that hair is cut through horizontal rotation of a blade is disclosed, and similarly, in Chinese patent No. 201620917563.1 published on Mar. 1, 2017, a blade body is also horizontally arranged in a floor drain to cut hairs.

SUMMARY OF THE INVENTION

The summary of the subject matter described in details in the specification is introduced below. The summary is not intended to limit the scope of protection of the claims.

An embodiment of the present invention provides a floor drain and a hair cutting assembly used for the floor drain, which is capable of cutting long and thin sundries such as hairs and fabrics into small sections, and thus, blockage of a drainage pipe is prevented.

An embodiment of the present invention relates to a hair cutting assembly which comprises at least one first shearing wheel, at least one second shearing wheel, a first transmission shaft and a second transmission shaft, an end surface of each first shearing wheel is intersected with a side wall to form a first cutting blade, and an end surface of each second shearing wheel is intersected with a side wall to form a second cutting blade; the first transmission shaft is connected with all of the first shearing wheels in a rotation-stopping manner; the second transmission shaft is connected with all of the second shearing wheels in a rotation-stopping manner; the first shearing wheels and the second shearing wheels are arranged horizontally and being spaced from one another, and opposite end surfaces of each first shearing wheel and the corresponding second shearing wheel are attached to each other; the first transmission shaft and the second transmission shaft are distributed in parallel and are rotatably connected by an engaged gear set such that drives the first shearing wheels and the second shearing wheels rotate relatively, thus, the first cutting blades and the second cutting blades move oppositely in a feed direction, the long and thin linear sundries such as the hairs and the fabrics can be shorn continuously, and then the sundries can be cut into small sections.

An embodiment of the present invention further relates to a floor drain which comprises a floor drain seat, a surface cover and a manual hair cutting device which is assembled in the floor drain seat. Wherein the manual hair cutting device comprises the hair cutting assembly, a support and a first transmission assembly. The cutting can be implemented by the user through extending a driving piece into the surface cover to drive the first transmission assembly and in turn drive the hair cutting assembly.

An embodiment of the present invention relates to another floor drain which comprises a floor drain seat, a surface cover and an electric hair cutting device which is assembled in the floor drain seat. Wherein the electric hair cutting device comprises the hair cutting assembly, a support, a first motor and a second transmission assembly. The first motor drives the hair cutting assembly through the second transmission assembly such that the cutting can be implemented.

BRIEF DESCRIPTION OF THE DRAWINGS

To describe the technical scheme of the embodiments of the present invention more clearly, the following briefly introduces the accompanying drawings required for describing the embodiments. Apparently, the accompanying drawings in the following description show only some embodiments of the present invention, and a person of ordinary skill in the art may still derive other drawings from these accompanying drawings without creative efforts.

DESCRIPTION OF THE EMBODIMENTS

The technical scheme in embodiments of the present invention will be described with reference to the accompanying drawings in the embodiments of the present invention.

Embodiment I

Figure 1:
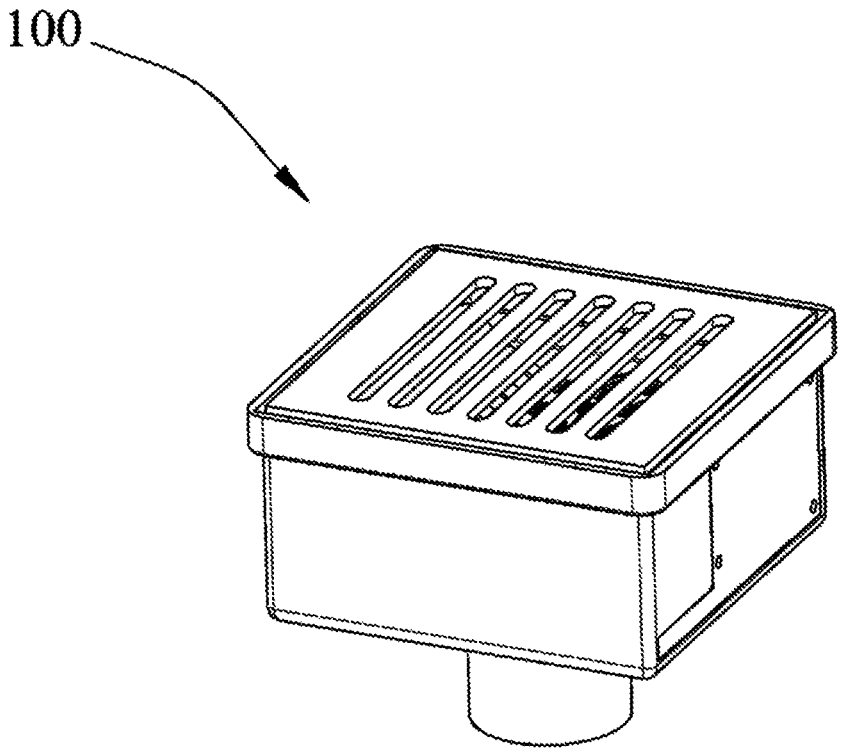
FIG. 1 is a three-dimensional view of a floor drain in an embodiment I of the present invention.
Figure 2:
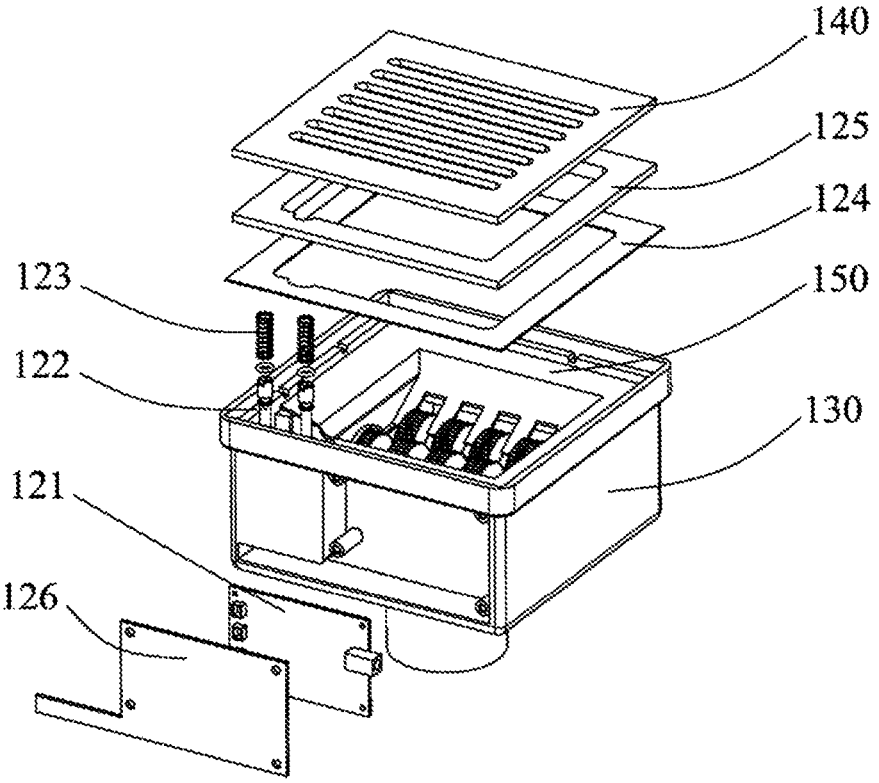
FIG. 2 is a first structural explosive view of a floor drain in the embodiment I of the present invention.
Figure 3:
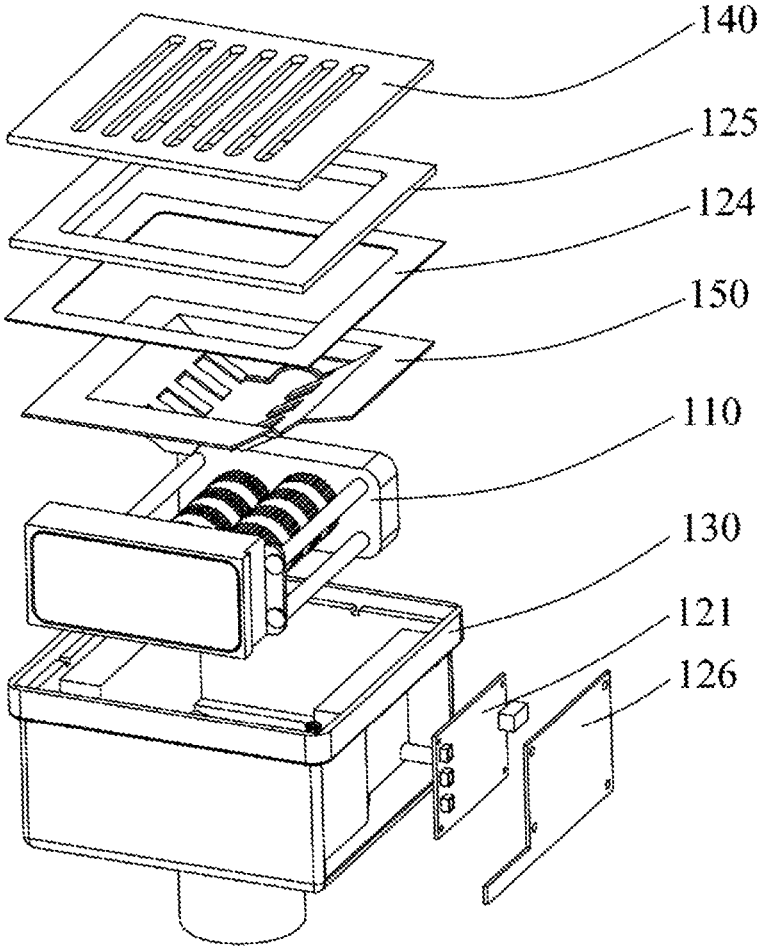
FIG. 3 is a second structural explosive view of the floor drain in the embodiment I of the present invention.
Figure 4:
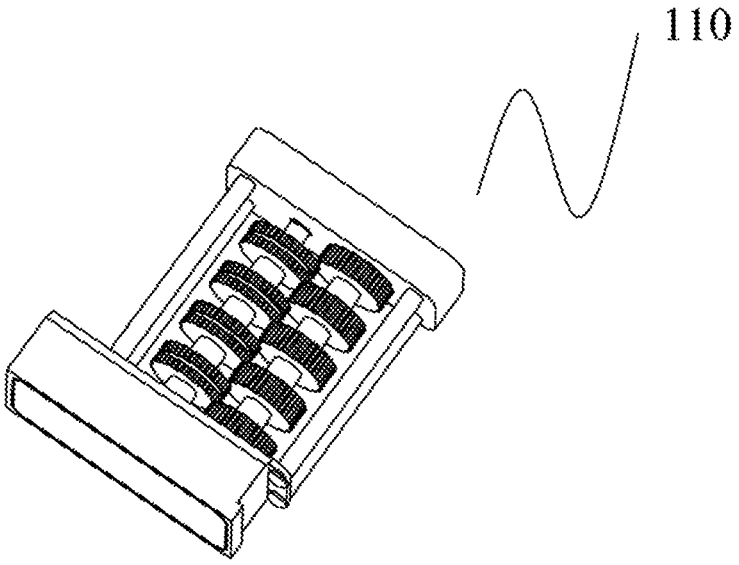
FIG. 4 is a three-dimensional view of an electric hair cutting device in the embodiment I of the present invention.
Figure 5:
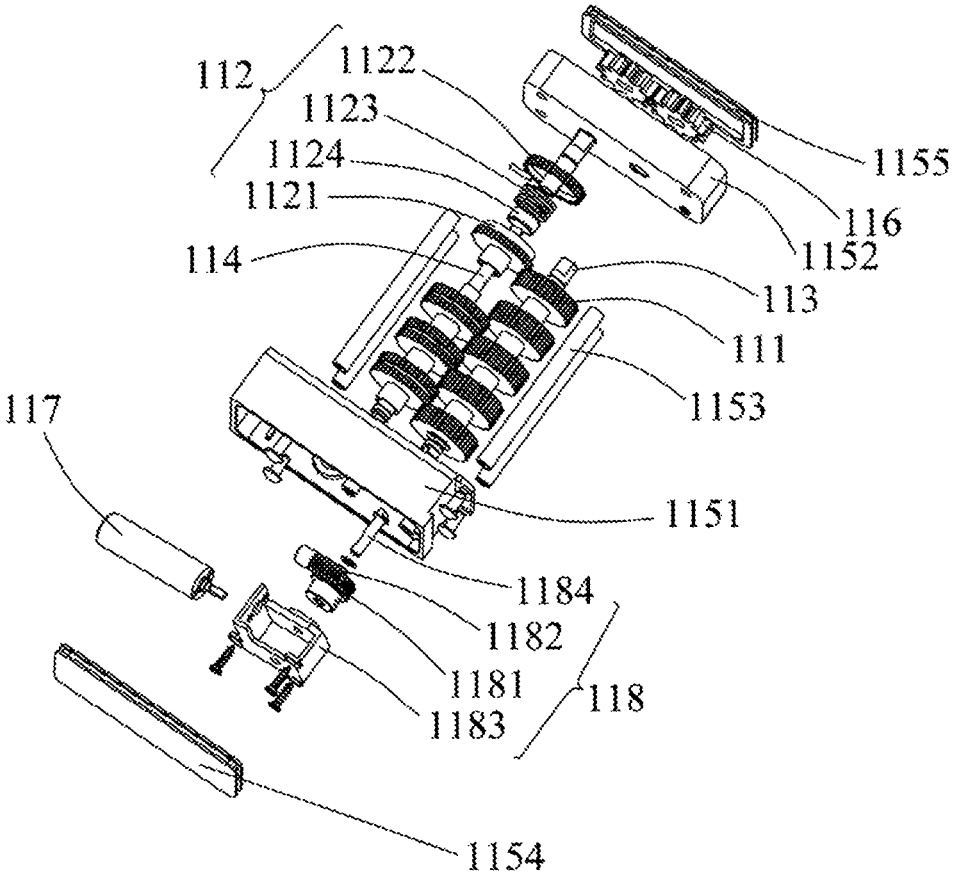
FIG. 5 is a structural explosive view of the electric hair cutting device in the embodiment I of the present invention.

Referring to FIG. 1 to FIG. 9 simultaneously, the present embodiment provides a floor drain 100 with an electric hair cutting function, and the floor drain 100 comprises an electric hair cutting device 110, a water flowing detection device, a floor drain seat 130, a surface cover 140 and a grate 150. Wherein, as shown in FIG. 4 and FIG. 5, the electric hair cutting device 110 comprises a hair cutting assembly, a support, a first motor 117 and a second transmission assembly 118.

Figure 7:
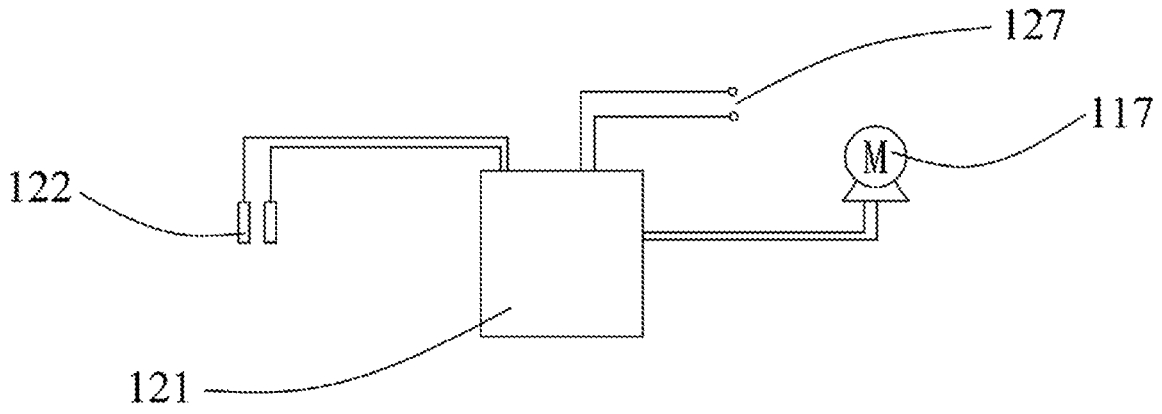
FIG. 7 is a schematic circuit diagram of water flowing detection in the embodiment I.

The hair cutting assembly comprises five first shearing wheels 111, four second shearing wheels 112, a first transmission shaft 113, a second transmission shaft 114 and a gear set 116. An end surface of each first shearing wheel 111 is intersected with a side wall to form a first cutting blade, and an end surface of each second shearing wheel 112 is intersected with a side wall to form a second cutting blade. The first shearing wheels 111 are horizontally arranged, are spaced from one another, and are connected with the first transmission shaft 113 in a rotation-stopping manner. As shown in FIG. 5 and FIG. 7, each second shearing wheel 112 comprises a first wheel plate 1121 and a second wheel plate 1122, the first wheel plates 1121 and the second wheel plates 1122 are connected with the second transmission shaft 114 in a rotation-stopping manner through hinge pins, each first wheel plate 1121 and the corresponding second wheel plate 1122 are mutually nested in the axial direction on the second transmission shaft 114 to form the corresponding second shearing wheel 112, and thus, the second shearing wheels 112 are arranged horizontally, are spaced from one another among the adjacent first shearing wheels 111, and are connected with the second transmission shaft 114 in a rotation-stopping manner. Because each first wheel plate 1121 and the corresponding second wheel plate 1122 are nested in the axial direction, a spring 1123 is clad inside each second shearing wheel, and the circumstance that the long and thin sundries such as hairs and fabrics are wound on the springs 1123 to affect running of the hair cutting assembly can be avoided. In the present embodiment, a stopping sleeve 1124 is further provided, and the stopping sleeve 1124 is connected to the hinge pins of the second transmission shaft 114 in a sleeving manner, and prevents the hinge pins from being separated from the second transmission shaft 114 in a rotating process of the second transmission shaft 114. The first transmission shaft 113 and the second transmission shaft 114 are disposed parallel to each other, so that opposite end surfaces of each first shearing wheel 111 and the corresponding second shearing wheel 112 are attached to each other. A first gap is formed between each first shearing wheel 111 and the second transmission shaft 114, a second gap is formed between each second shearing wheel 112 and the first transmission shaft 113, the gaps serve as discharge channels for cut sundries, therefore, the cut sundries can be discharged in time, and continuous operation of the hair cutting assembly is ensured.

In the present embodiment, each spring 1123 is arranged between the first wheel plate 1121 and the second wheel plate 1122 of the corresponding second shearing wheel 112, each spring 1123 is compressed and connected to the second transmission shaft 114 in a sleeving manner, thus, rebound force is generated between each first wheel plate 1121 and the corresponding second wheel plate 1122, each second shearing wheel 112 is attached to the corresponding adjacent first shearing wheel 111 in an elastic abutted manner because of the rebound force of the corresponding spring 1123, thus preventing each first shearing wheel 111 and the corresponding second shearing wheel 112 from sliding axially in a rotation process to implement shearing at the attached position, thus, the long and thin linear sundries such as the hairs and the fabrics are shorn continuously, and then the sundries are cut into small sections. The first transmission shaft 113 and the second transmission shaft 114 are rotatably connected through the externally engaged gear set 116, so that the first transmission shaft 113 and the second transmission shaft 114 can synchronously drive the first shearing wheels 111 and the second shearing wheels 112 to rotate relatively, and the first cutting blades and the second cutting blades move oppositely in the feed direction.

Of course, the first shearing wheel 111 may be provided as two wheel plates being axially nested in an axial direction, and a spring may be provided in between. Since it is similar to the arrangement of the second shearing wheel 112 of the present embodiment, the descriptions thereof are omitted herein.

In the present embodiment, convex teeth which are parallel to the axes of the first shearing wheels 111 and the second shearing wheels 112 are respectively arranged on side walls of the first shearing wheels 111 and side walls of the second shearing wheels 112, grooves among the convex teeth can accommodate the long and thin sundries such as the hairs and the fabrics, therefore, the sundries on the side walls of the first shearing wheels and on the side walls of the second shearing wheels can be brought in shearing positions and are prevented from being washed away by water flow, the feed efficiency is improved, the sundries shearing effect can also be ensured, and the cutting efficiency is improved.

The support comprises a first support 1151 and a second support 1152 which are respectively arranged between two ends of the first transmission shaft 113 and between two ends of the second transmission shaft 114, so that the first support 1151 and the second support 1152 can rotatably support the first transmission shaft 113 and the second transmission shaft 114. In addition, in the present embodiment, four struts 1153 are further provided, and two ends of each strut 1153 are respectively fixedly connected with the first support 1151 and the second support 1152 to enhance the integral stability and reliability of the support. The externally engaged gear set 116 is assembled on the second support 1152 through a second cabin cover 1155, so that the first transmission shaft 113 and the second transmission shaft 114 are rotatably connected in the second support 1152.

A fixed end of the first motor 117 is fixedly connected to the first support 1151, specifically, the first motor 117 is fixedly connected to the first support 1151 through a worm and worm gear seat 1183, and are covered in the first support 1151 through a first cabin cover 1154.

The second transmission assembly 118 comprises a worm gear 1181 and a worm 1182. An output end of the first motor 117 is fixedly connected with a worm 1182, the first transmission shaft 113 is fixedly connected with a worm gear 1181 through a third transmission shaft 1184, and the worm gear 1181 and the worm 1182 are engaged with each other to carry out transmission. The rotating speed of the first motor is reduced by the worm and worm gear mechanism, torque which is output to the first transmission shaft is increased, the shearing force of the first cutting blades and the second cutting blades can be increased, the cutting effect is improved, and since the worm and worm gear mechanism are adopted, the occupied space is saved, the second transmission assembly can be easily integrated into the floor drain seat 130.

According to the electric hair cutting device 110 of the present embodiment, by driving the first motor 117, the worm 1182 is driven to be engaged with the worm gear 1181 to rotate, the rotation of the first motor 117 is transmitted to the first transmission shaft 113 through the second transmission assembly 118, the gear set 116 drives the second transmission shaft 114 to synchronously rotate relatively, thus, side walls of the first shearing wheels 111 and the second shearing wheels 112 which rotate relatively serve as feed surfaces, the first cutting blades and the second cutting blades which correspond to attached end surfaces rotate relatively in the feed direction, shearing positions are formed at positions where the first cutting blades are attached to the second cutting blades, and then the long and thin linear sundries such as the hairs and the fabrics are continuously shorn.

In the present embodiment, the water flowing detection device comprises a circuit board 121, guide rods 122, touch springs 123, a first plate electrode 124, a second plate electrode and an insulating plate 125.

The water flowing detection device functionally comprises a power supply module, a detection module and a control module, a schematic circuit diagram of the water flowing detection device is as shown in FIG. 7, and the power supply module is used for accessing a power supply 127 which provides driving electric energy for the water flowing detection device and the first motor 117; a circuit part in the detection module is also integrated on the circuit board 121, and is provided with two guide rods 122 which are connected with the circuit board 121, when the two guide rods 122 are conducted through water, the two guide rods 122 and the circuit part form a loop, and the circuit part generates a water flowing signal according to a conduction signal of the two guide rods 122, and transmits the water flowing signal to the control module; and the control module is integrated on the circuit board 121, is electrically connected with the first motor 117 to control running of the first motor 117 according to the water flowing signal, and then controls actions of the electric hair cutting device 110. Therefore, startup and shutdown of the electric hair cutting device do not need to be controlled manually, the electric hair cutting device is convenient to use, furthermore, the sundries such as the hairs and the fabrics which enter the floor drain can be cut in time, and the using effect is improved.

Figure 6:
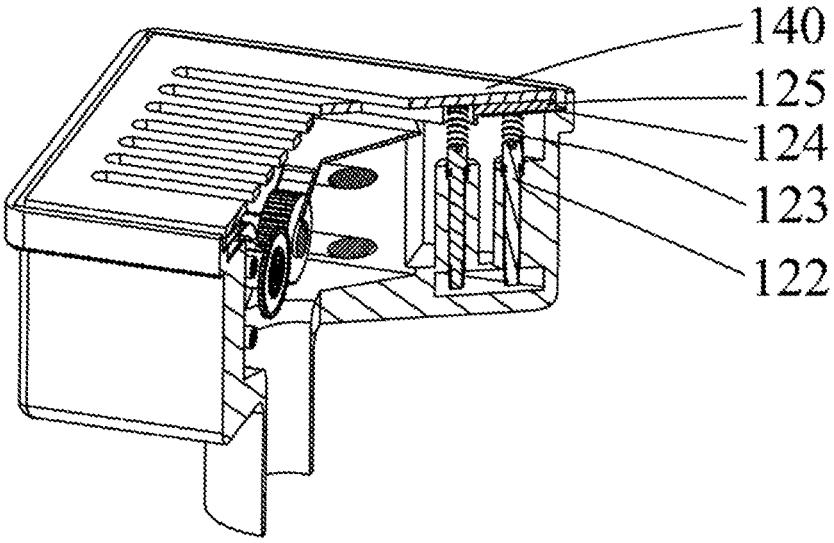
FIG. 6 is a first cross-sectional view of the floor drain in the embodiment I of the present invention.

As shown in FIG. 2, FIG. 3 and FIG. 6, in the present embodiment, the circuit board 121 is fixedly mounted on one side of the floor drain seat 130 through a circuit cover plate 126; the first plate electrode 124 is arranged in the floor drain seat 130, the second plate electrode is directly implemented by the surface cover 140 with a conductive function, and thus, no matter from which way water flows into the floor drain 100, it can be detected; moreover, the insulating plate 125 is further arranged between the first plate electrode 124 and the surface cover 140 to ensure that the first plate electrode 124 and the second plate electrode are in a disconnect state when no water conducts, misjudgment of the detection module is prevented, and reliability is improved; and the bottom ends of the two guide rods 122 are connected with the circuit board 121, and the top ends of the two guide rods 122 are respectively connected with the first plate electrode 124 and the surface cover 140 electrically through the touch springs 123 in an elastic abutted manner.

When the surface cover 140 and the first plate electrode 124 are conducted through water, the two guide rods 122 communicate with each other in a conductive manner, and the detection module produces a water flowing signal according to the conduction signal of the two guide rods 122, and transmits the water flowing signal to the control module; and the control module transmits a running command to the first motor 117 according to the received water flowing signal, so that the electric hair cutting device 110 works, and thus automatic running of the electric hair cutting device 110 is realized.

Figure 8:
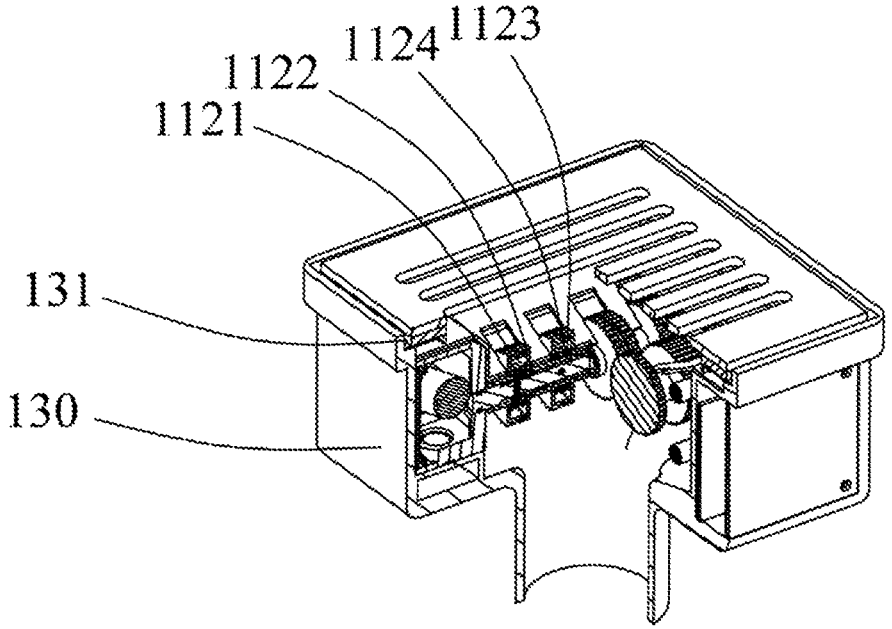
FIG. 8 is a second cross-sectional view of the floor drain in the embodiment I of the present invention.
Figure 9:
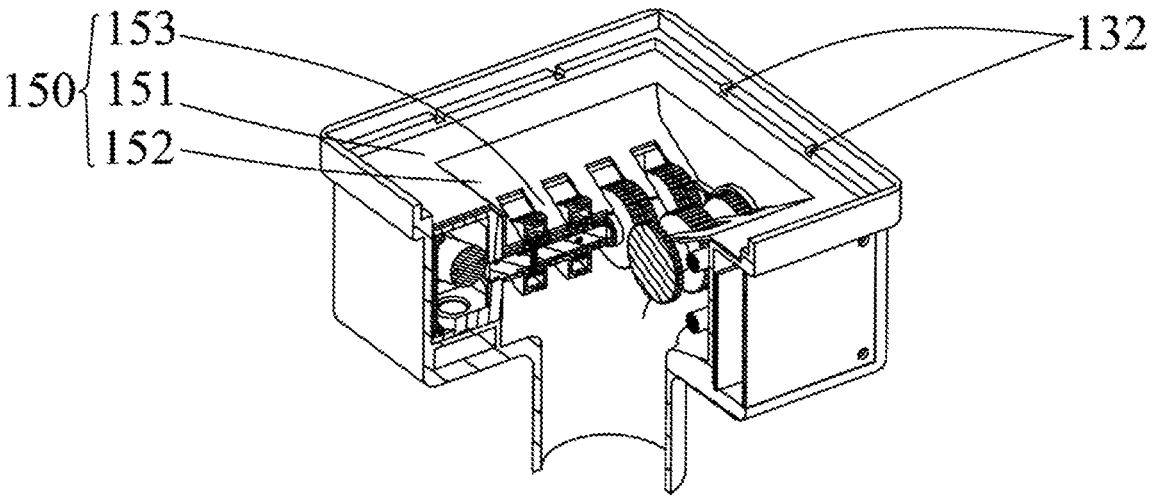
FIG. 9 is a partial cross-sectional view of the floor drain in the embodiment I of the present invention.
Figure 10:
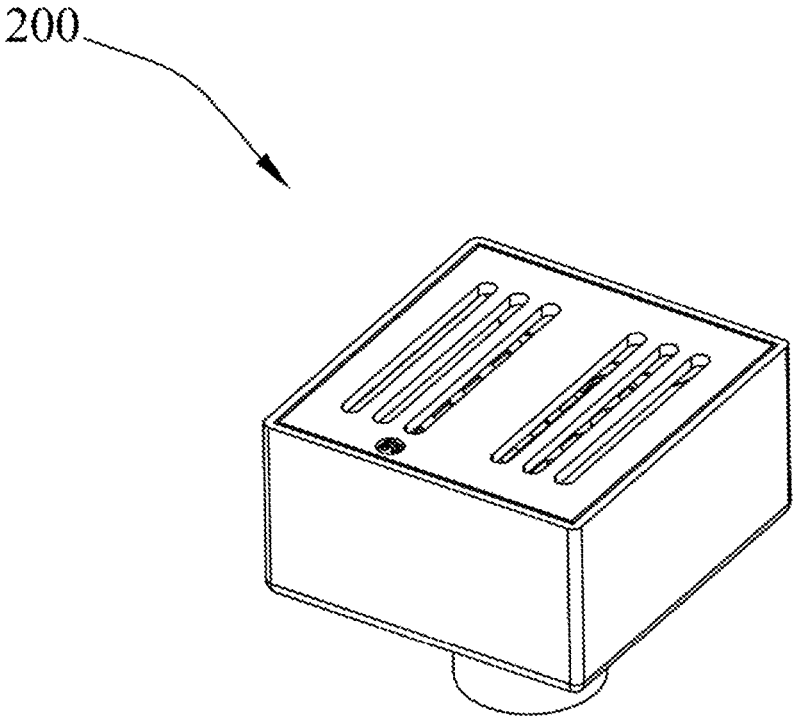
FIG. 10 is a three-dimensional view of a floor drain in an embodiment II of the present invention.

As shown in FIG. 8 and FIG. 9, the floor drain seat 130 which is used as a floor drain main body not only has a water flow guiding effect, but also provides mounting space for the electric hair cutting device 110 and the water flowing detection device. After the first plate electrode 124, the insulating plate 125 and the surface cover 140 are assembled on the floor drain seat 130, a water accumulating groove 131 which surrounds the floor drain seat 130 is enclosed by the inner side wall of the floor drain seat 130, the first plate electrode 124 as well as side walls of the insulating plate 125 and the surface cover 140 jointly. When water on the ground flows to the inlet of the floor drain 100, the water may enter the water accumulating groove 131 first, thus, the first plate electrode 124 and the surface cover 140 are conducted, detection reliability of the detection module is ensured, furthermore, it can be ensured that the electric hair cutting device 110 runs before hairs enter the floor drain 100, the circumstance that hairs which are not cut enter the drainage pipe is prevented, and the cutting effect is improved. In addition, the floor drain seat 130 is further provided with a water leaking groove 132, the water leaking groove 132 communicates with the water accumulating groove 131 and a drain hole of the floor drain 100, thus, accumulated water in the water accumulating groove 131 can be drained rapidly through the water leaking groove 132 so as to rapidly disconnect electric connection between the first plate electrode 124 and the surface cover 140 after the accumulated water on the ground is drained, then the control module controls the first motor 117 to be shut down, electric energy is saved, and the running efficiency is improved.

The surface cover 140 is not only used for stopping large sundries from entering the floor drain 100, but also can filter out most of sundries such as hairs, so that work burden of the electric hair cutting device 110 is relieved, meanwhile, the surface cover 140 with the conductive function is adopted, the surface cover 140 further plays functions of the second plate electrode in the detection module, therefore, the complexity degree of the structure of the floor drain 100 is simplified, and the cost is reduced.

As shown in FIG. 2, FIG. 3 and FIG. 9, the grate 150 is attached above the electric hair cutting device 110, is used for covering a gap between the electric hair cutting device 110 and the inner side wall of the floor drain seat 130, prevents the sundries such as the hairs and the fabrics from directly dropping in the drainage pipe from the gap, and guides the sundries to drop to the side walls of the first shearing wheels 111 and the side walls of the second shearing wheels 112. The grate 150 comprises an assembling part 151, a first stopping part 152 and a second stopping part 153. The assembling part 151 and the floor drain seat 130 form an assembling surface, and the assembling part 151 is used for mounting the grate 150 in the floor drain seat 130; the first stopping part 152 is inclined to the first shearing wheels 111 and the second shearing wheels 112 from the assembling part 151 and extend to the centers to stop the hairs from dropping in a cavity of the floor drain seat 130 from the gap between the inner side wall of the floor drain seat 130 and the first shearing wheels 111 and the gap between the inner side wall of the floor drain seat 130 and the second shearing wheels 112; and the second stopping part 153 extends from the first stopping part 152 and enters the gaps among the adjacent first shearing wheels 111 and the gaps among the adjacent second sharing wheels 112 to stop hairs from dropping in the cavity of the floor drain seat 130 from the gaps among the adjacent first shearing wheels 111 and the gaps among the adjacent second shearing wheels 112, and thus, the sundries such as the hairs which are not cut are prevented from entering the drainage pipe.

The floor drain 100 with the electric hair cutting function in the present embodiment is adopted, the electric hair cutting device 110 is assembled in the floor drain seat 130, the water flowing detection device is assembled, the electric hair cutting device 110 is automatically controlled to run so as to cut the sundries such as the hairs and the fabrics according to the water flowing condition of the floor drain 100, the circumstance that the long and thin sundries such as the hairs and the fabrics enter the drainage pipe to block the drainage pipe is avoided, thus time and effort for manual operation are saved, and the use experience of the floor drain 100 is improved.

Embodiment II

Figure 11:
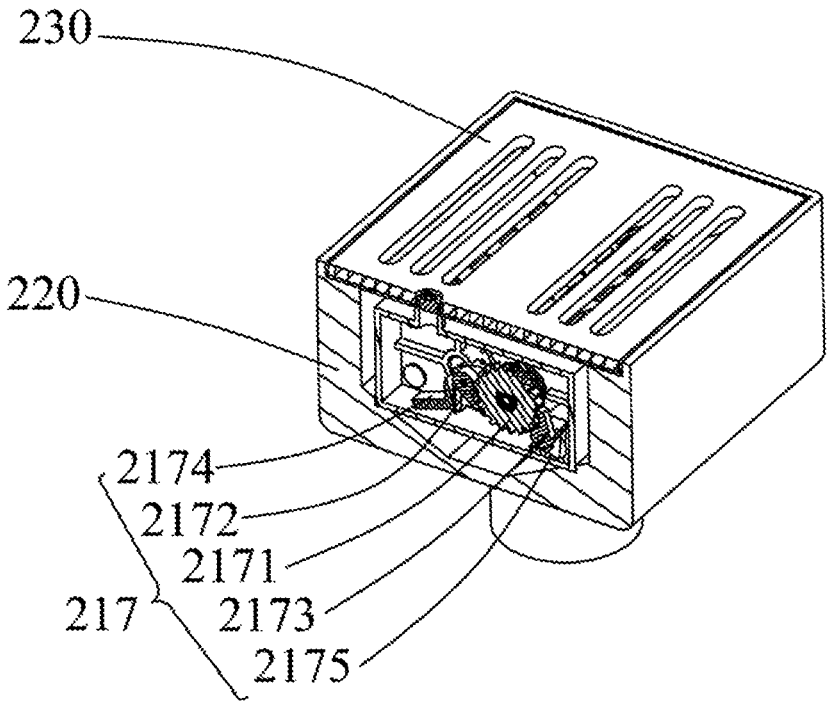
FIG. 11 is a cross-sectional view of the floor drain in the embodiment II of the present invention.
Figure 12:
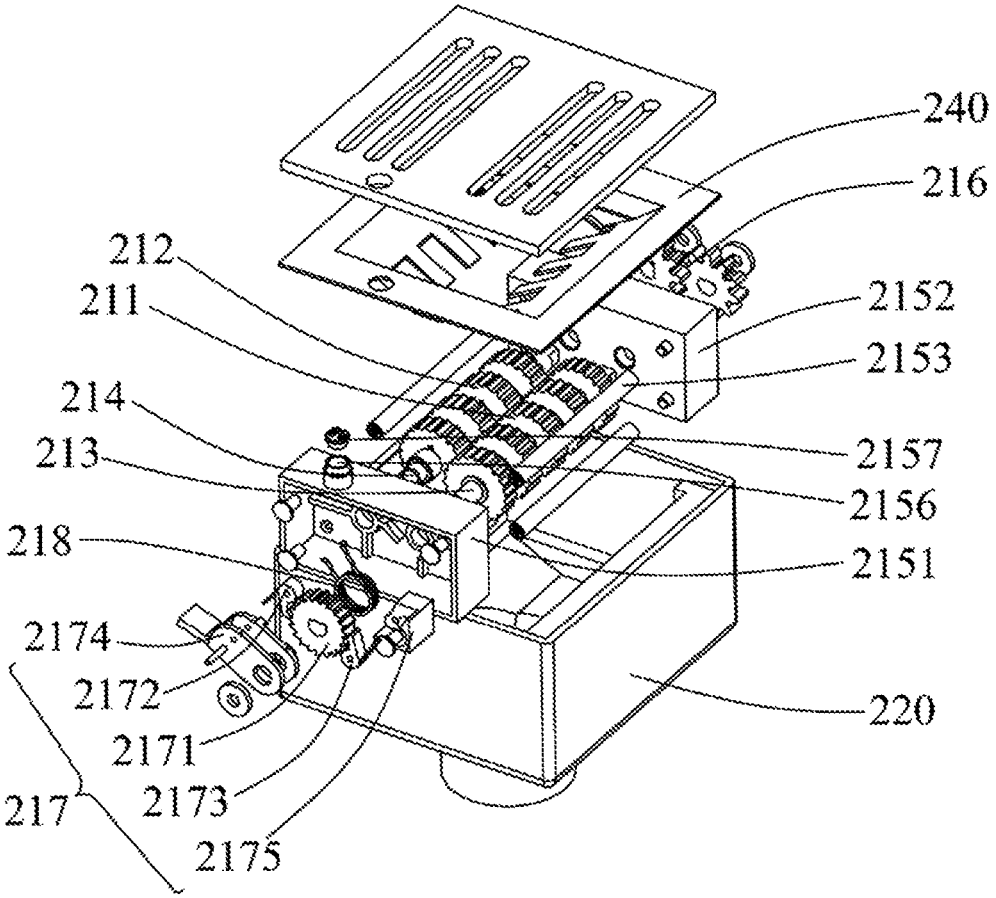
FIG. 12 is a structural explosive view of the floor drain in the embodiment II of the present invention.

Referring to FIG. 10 to FIG. 13 simultaneously, the present embodiment provides a floor drain 200 with a manual hair cutting function, and the floor drain 200 comprises a manual hair cutting device, a floor drain seat 220, a surface cover 230 and a grate 240. Wherein, as shown in FIG. 11 and FIG. 12, the manual hair cutting device comprises a hair cutting assembly, a first transmission assembly and a support.

The hair cutting assembly of the present embodiment comprises five first shearing wheels 211, four second shearing wheels 212, a first transmission shaft 213, a second transmission shaft 214 and a gear set 216. An end surface of each first shearing wheel 211 is intersected with a side wall to form a first cutting blade, and an end surface of each second shearing wheel 212 is intersected with a side wall to form a second cutting blade. The first shearing wheels 211 are arranged horizontally, are spaced from one another, and are connected with the first transmission shaft 213 in a rotation-stopping manner; and the second shearing wheels 212 are arranged horizontally, are spaced from one another, and are connected with the second transmission shaft 214 in a rotation-stopping manner. The first transmission shaft 213 and the second transmission shaft 214 are parallel to each other, so that opposite end surfaces of each first shearing wheel 211 and the corresponding second shearing wheel 212 are attached to each other. A first gap is formed between each first shearing wheel 211 and the second transmission shaft 214, and a second gap is formed between each second shearing wheel 212 and the first transmission shaft 213.

The first transmission shaft 213 and the second transmission shaft 214 are rotatably connected through the externally engaged gear set 216, so that the first transmission shaft 213 and the second transmission shaft 214 can synchronously drive the first shearing wheels 211 and the second shearing wheels 212 to rotate relatively, and the first cutting blades and the second cutting blades move oppositely in a feed direction. In the present embodiment, convex teeth which are parallel to axes of the first shearing wheels 211 and the second shearing wheels 212 are respectively arranged on the side walls of the first shearing wheels 211 and the side walls of the second shearing wheels 212, and grooves among the convex teeth can accommodate long and thin sundries such as hairs and fabrics.

In other embodiments, the first transmission shaft 213 and the second transmission shaft 214 can be simultaneously connected with a plurality of springs in a sleeving manner, and the plurality of springs are elastically compressed among the end surfaces of the adjacent first shearing wheels 211 and among the end surfaces of the adjacent second shearing wheels 212, so that opposite end surfaces of each first shearing wheel 211 and the corresponding second shearing wheel 212 are attached to each other in an elastic abutted manner. By arrangement of the springs, the circumstance that due to axial sliding of the first shearing wheels 211 and the second shearing wheels 212 in a rotation process, a gap exists between the end surfaces, which are attached to each other, of each first shearing wheel 211 and the corresponding second shearing wheel 212 to affect shearing actions of the first cutting blades and the second cutting blades can be prevented effectively, and therefore, the shearing efficiency is improved.

Figure 13:
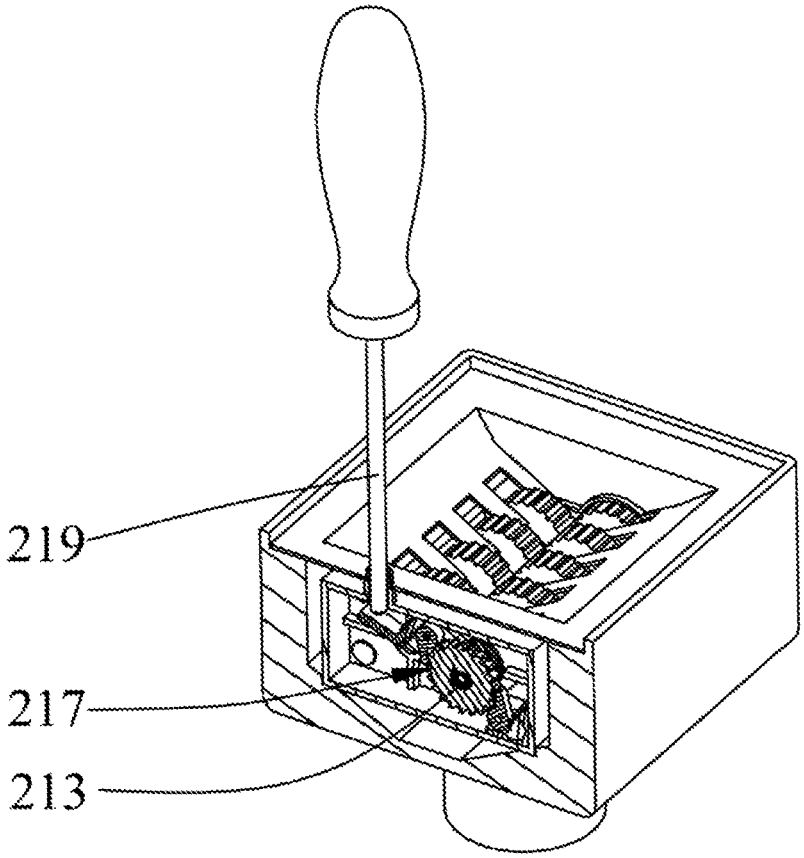
FIG. 13 is a schematic diagram of a using state of the floor drain in the embodiment II of the present invention.
Figure 14:
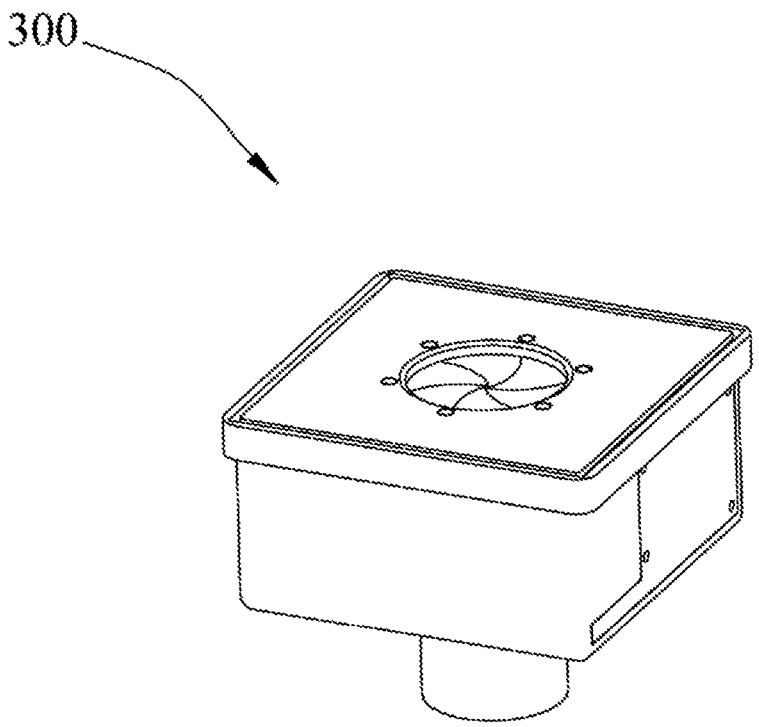
FIG. 14 is a three-dimensional view of a floor drain in an embodiment III of the present invention.

As shown in FIG. 12 and FIG. 13, the first transmission assembly of the present embodiment comprises a ratchet mechanism 217, a torsional spring 218 and a driving piece 219. The ratchet mechanism 217 comprises a ratchet 2171, a first pawl 2172, a second pawl 2173, an oscillating bar 2174 and a pawl seat 2175. The ratchet 2171 is fixedly connected with the first transmission shaft 213; the oscillating bar 2174 is pivotally connected to the first transmission shaft 213 and can rotate around the first transmission shaft 213; the first pawl 2172 is pivotally connected to the oscillating bar 2174 through a hinge pin, and is abutted against ratchet teeth of the ratchet 2171 in one way, when the oscillating bar 2174 rotates around the first transmission shaft 213 in the direction which is the same as the rotation direction of the ratchet 2171, the oscillating bar 2174 drives the first pawl 2172 to push the ratchet 2171 to rotate, then the first transmission shaft 213 is driven to rotate, and when the oscillating bar 2174 rotates around the first transmission shaft 213 in a direction which is reversed to the rotation direction of the ratchet 2171, the oscillating bar 2174 drives the first pawl 2172 to slide on the side wall of the ratchet 2171; and the second pawl 2173 is pivotally connected to the pawl seat 2175 through a hinge pin, and is fixedly connected with the support through the pawl seat 2175, when the first pawl 2172 pushes the ratchet 2171 to rotate, the second pawl 2173 slides on the side wall of the ratchet 2171, and when the oscillating bar 2174 resets and rotates, the second pawl 2173 is abutted against the ratchet teeth of the ratchet 2171 in one way to prevent the ratchet 2171 from rotating. The torsional spring 218 is connected to the first transmission shaft 213 in a sleeving manner, when the oscillating bar 2174 drives the ratchet 2171 to rotate, torsional deformation of the torsional spring 218 is caused, rebound energy is stored, when external force applied on the oscillating bar 2174 is withdrawn, the stored rebound energy of the torsional spring 218 is released, and the torsional spring 218 recovers to be in the initial shape, and drives the oscillating bar 2174 to reset.

The support comprises a first support 2151 and a second support 2152 which are respectively formed at the two ends of the first transmission shaft 213 axially and the two ends of the second transmission shaft 214 axially so as to rotatably support the first transmission shaft 213 and the second transmission shaft 214 at the two ends of the first transmission shaft 213 and the two ends of the second transmission shaft 214. In addition, in the present embodiment, four struts 2153 are further provided, and two ends of each strut 2153 are respectively fixedly connected with the first support 2151 and the second support 2152 to enhance the integral stability and reliability of the support. The ratchet mechanism 217 and the torsional spring 218 are mounted on the first support 2151, and are covered in the first support 2151 through a first cabin cover. The first support 2151 is provided with a driving piece channel 2156 and a rubber plug 2157, the driving piece 219 can extend into the driving piece channel 2156 to press the oscillating bar 2174, the rubber plug 2157 is used for sealing the driving piece channel 2156, and thus, the driving piece 219 can penetrate through the driving piece channel 2156 to press the oscillating bar 2174 assembled in the first support 2151; the driving piece 219 does not need to be specially machined or assigned, as long as the driving piece 219 can penetrate into the driving piece channel 2156, the oscillating bar 2174 can be pressed, and thus the use is convenient; and when the rubber plug 2157 blocks the driving piece channel 2156, water flow can be effectively prevented from entering the first support 2151 from the driving piece channel 2156, and thus, normal operation of the first transmission assembly is ensured. The externally engaged gear set 216 is assembled on the second support 2152 through a second cabin cover, so that the first transmission shaft 213 and the second transmission shaft 214 are rotatably connected in the second support 2152.

According to the manual hair cutting device of the present embodiment, the driving piece 219 presses the oscillating bar 2174, the first pawl 2172 is driven to push the ratchet 2171 to rotate, up-down pressing movement of the driving piece 219 is transformed into one-way rotation of the first transmission shaft 213, the gear set 216 drives the second transmission shaft 214 to synchronously rotate relatively, thus, the side walls of the first shearing wheels 211 and the second shearing wheels 212 which rotate relatively serve as feed surfaces, the first cutting blades and the second cutting blades which correspond to attached end surfaces rotate relatively in the feed direction, shearing positions are formed at positions where the first cutting blades are attached to the second cutting blades, and then the long and thin linear sundries such as the hairs and the fabrics are continuously shorn.

The manual hair cutting device is mounted in the floor drain seat 220, and the grate 240 and the surface cover 230 are successively arranged above the manual hair cutting device. As shown in FIG. 12, the structures and functions of the grate 240 and the surface cover 230 of the present embodiment are basically the same as the structures and functions of the grate 150 and the surface cover 140 of the embodiment I, but abdicating holes are formed in corresponding positions of the grate 240 and the surface cover 230, thus, the driving piece channel 2156 can penetrate through the abdicating holes when the grate 240 and the surface cover 230 are mounted on the floor drain seat 220, and the rubber plug 2157 can be taken down and placed conveniently.

The floor drain 200 with the manual hair cutting function of the present embodiment is adopted, the manual hair cutting device is assembled in the floor drain seat 220, when the sundries such as the hairs and the fabrics require to be cut, the rubber plug 2157 is taken down, the long and thin driving piece 219 penetrates through the driving piece channel 2156 to press the active oscillating bar 2174 so as to drive the manual hair cutting device to run, the sundries such as the hairs and the fabrics are cut first and then are discharged into the drainage pipe, and thus, the circumstance that the long and thin sundries such as the hairs and the fabrics enter the drainage pipe to block the drainage pipe is prevented.

Embodiment III

Figure 15:
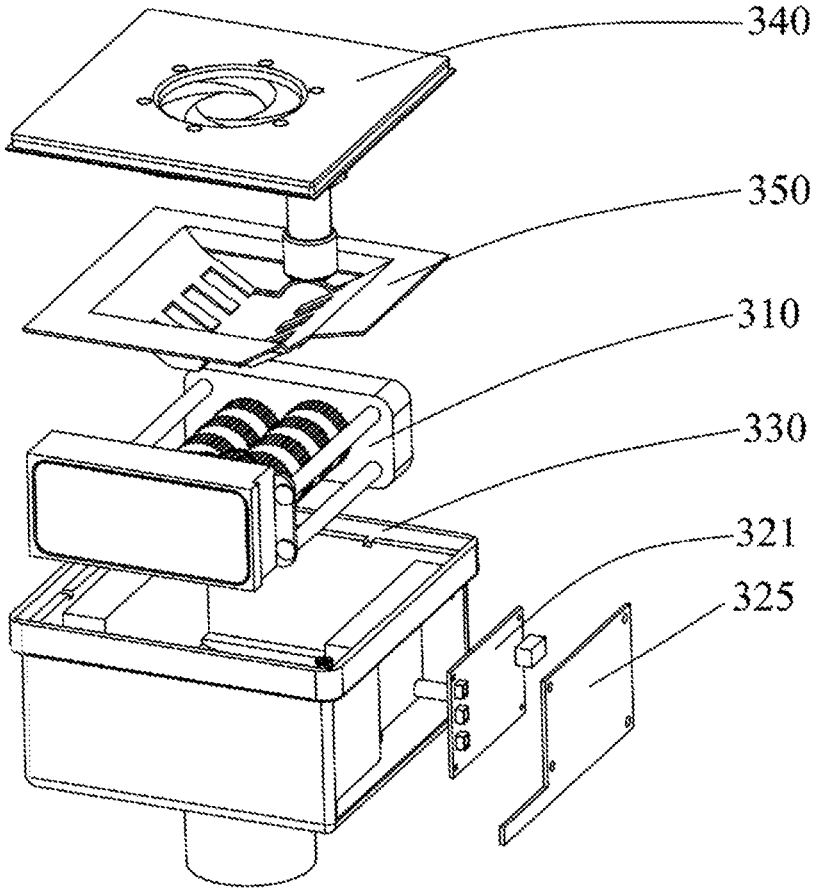
FIG. 15 is a structural explosive view of the floor drain in the embodiment III of the present invention.
Figure 16:
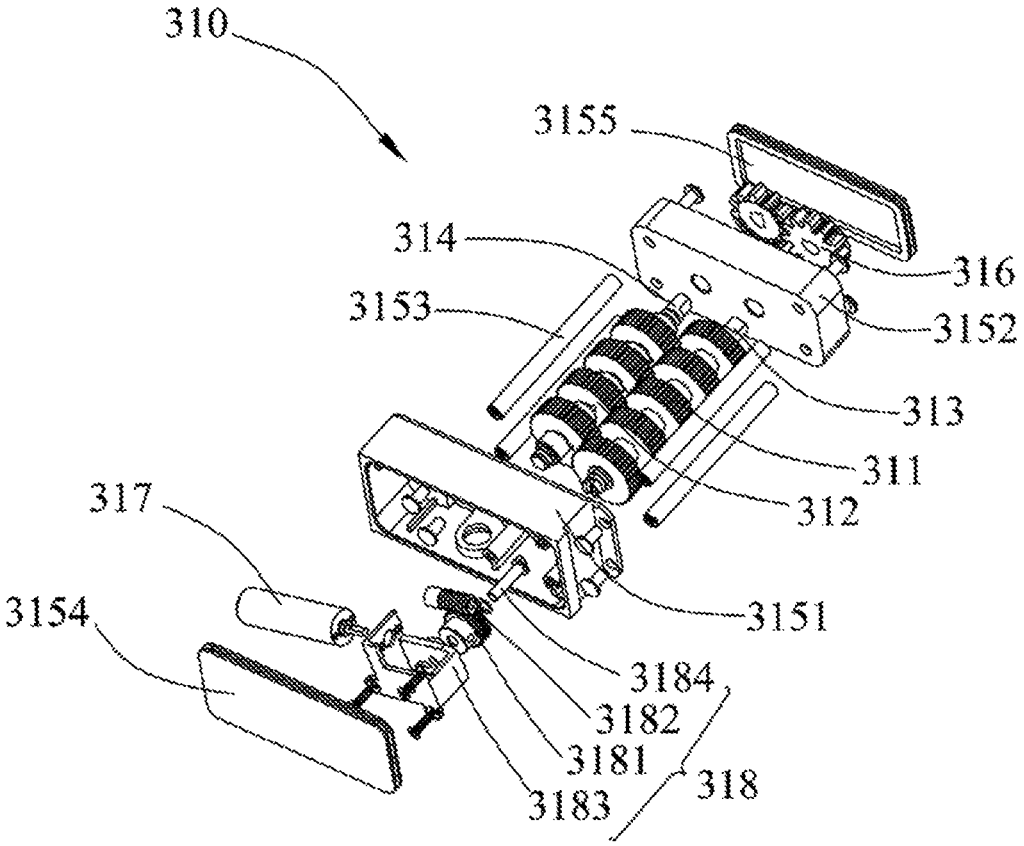
FIG. 16 is a structural explosive view of an electric hair cutting device in the embodiment III of the present invention.

Referring to FIG. 14 to FIG. 20 simultaneously, the present embodiment provides a floor drain 300 with an electric hair cutting function and an electric surface cover opening and closing function, and the floor drain 300 comprises an electric hair cutting device 310, a water flowing detection device, a floor drain seat 330, a surface cover 340 and a grate 350. Wherein, the electric hair cutting device 310 comprises a hair cutting assembly, a second transmission assembly and a support. The structure of the hair cutting assembly of the present embodiment is the same as the structure of the hair cutting assembly of the embodiment II, and the hair cutting assembly comprises five first shearing wheels 311, four second shearing wheels 312, a first transmission shaft 313, a second transmission shaft 314 and a gear set 316. The structure, the positional relation of the various components and beneficial effects of the hair cutting assembly of the present embodiment are shown in FIG. 15, FIG. 16 and descriptions about the hair cutting assembly in the embodiment II, and the descriptions thereof are omitted herein.

As shown in FIG. 16, the structure of the second transmission assembly of the present embodiment is the same as the structure of the second transmission assembly of the embodiment I, the second transmission assembly comprises a first motor 317 and a worm and worm gear mechanism 318. An output end of the first motor 317 is fixedly connected with a worm 3182, the first transmission shaft 313 is fixedly connected with a worm gear 3181 through a third transmission shaft 3184, the worm gear 3181 is engaged with the worm 3182 to carry out transmission, and the worm gear 3181 and the worm 3182 are assembled in a first support 3151 through a worm and worm gear seat 3183.

As shown in FIG. 16, the structure of the support of the present embodiment is the same as the structure of the support of the embodiment I, and the support comprises the first support 3151, a second support 3152, struts 3153, a first cabin cover 3154 and a second cabin cover 3155. The part is shown in descriptions about the support in the embodiment I.

Figure 17:
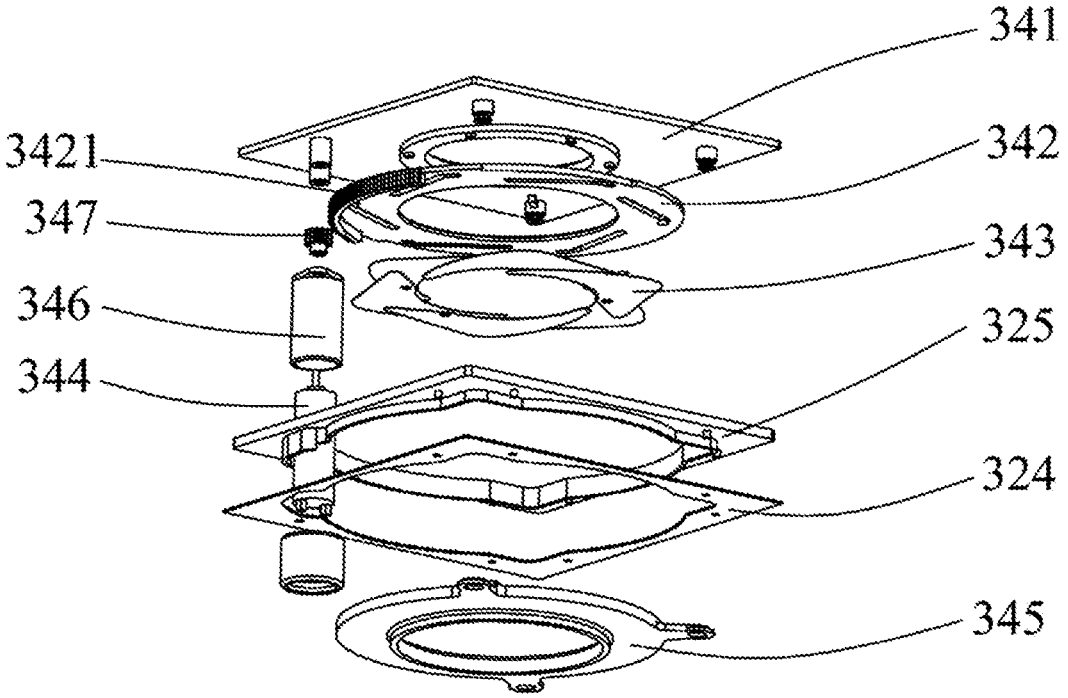
FIG. 17 is a structural explosive view of a surface cover of the floor drain in the embodiment III of the present invention.
Figure 18:
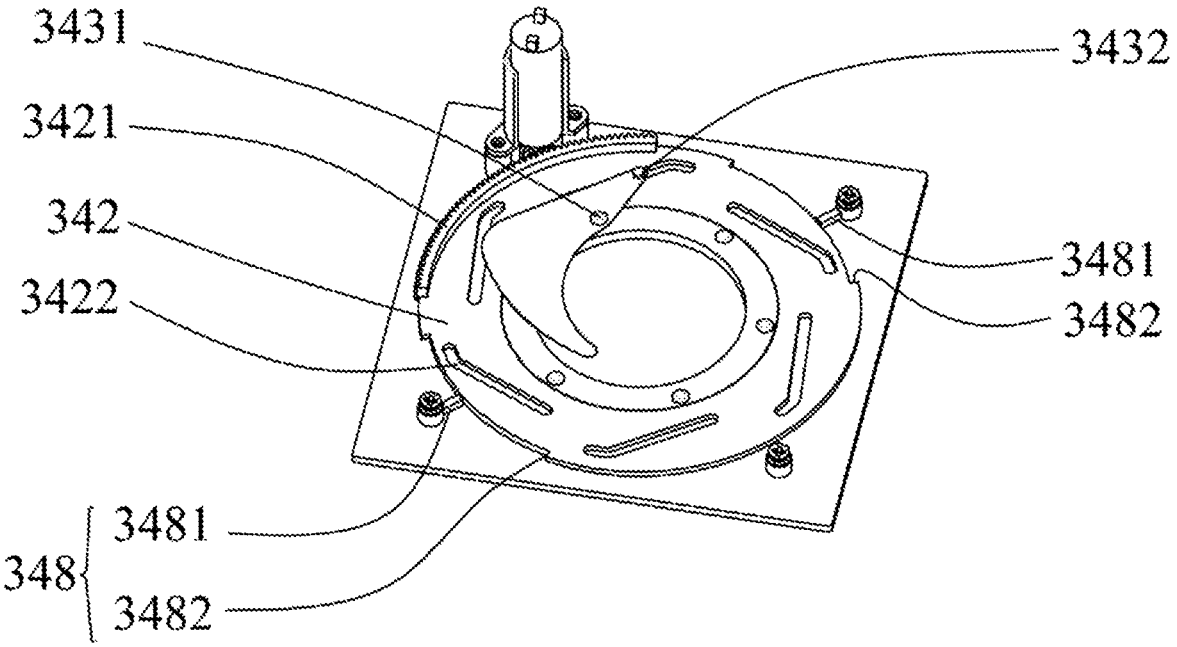
FIG. 18 is a schematic diagram of a movement state of blades of the surface cover of the floor drain in the embodiment III of the present invention.

As shown in FIG. 17 and FIG. 18, in the present embodiment, the surface cover 340 comprises a panel 341, a guide track plate 342, blades 343 and a second motor 344. The panel 341 is provided with circular water flowing through holes which allow water to flow into the floor drain seat 330. The guide track plate 342 is rotatably connected with the panel 341 through a pressing ring 345, a track groove 3422 is formed in a plate surface of the guide track plate 342, and ring teeth 3421 are arranged at the outer edge of the guide track plate 342. In the present embodiment, six blades 343 are provided, each blade 343 is pivotally connected to the lower surface of the panel 341 through a pivot shaft 3431, and the pivot shafts 3431 surround the water flowing through holes and are uniformly distributed in the peripheral direction to rotate relative to the panel 341 to open or close the water flowing through holes; each blade 343 is further provided with a guide column 3432, one end of each guide column 3432 is fixedly connected with the corresponding blade 343, the other ends of the guide columns 3432 are slidably arranged in the track groove 3422 so as to simultaneously drive the blades 343 to rotate around the respective pivot shafts 3431, and thus, the sealing effect is improved. The second motor 344 is assembled on a motor seat 346, and is fixedly connected with the panel 341 through the motor seat 346; and an output end of the second motor 344 is fixedly connected with a gear 347 which is engaged with the ring teeth 3421 of the guide track plate 342.

The surface cover 340 of the present embodiment is further provided with two rotation-stopping structures 348, each rotation-stopping structure consists of a first limiting protrusion 3481 arranged on the lower surface of the panel 341 and a second limiting protrusion 3482 arranged at the outer edge of the guide track plate 342, when the second motor 344 drives the guide track plate 342 to rotate, each second limiting protrusion 3482 is abutted against the corresponding first limiting protrusion 3481, the guide track plate 342 is stopped from continually rotating, thus, rotation of the second motor 344 stops, then the second motor 344 is shut down, and the circumstance that the blades 343 are staggered and damaged due to excessive rotation of the guide track plate 342 is prevented.

When the surface cover 340 with the electric opening and closing function of the present embodiment is used, the second motor 344 is driven to drive the gear 347 to be engaged with the ring teeth 3421 of the guide track plate 342 to rotate, the rotating guide track plate 342 drives the guide columns 3432 which are slidably arranged in the track groove 3422 to slide so as to simultaneously drive the various blades 343 to rotate around the respective pivot shafts 3431, and then water flowing through holes in the panel 341 are opened or closed jointly. When water is not drained through the floor drain 300, the water flowing through holes are closed through the blades 343, thus, the surface cover 340 completely covers the floor drain seat 330, effects of deodorizing and preventing insects are achieved, and furthermore, water in a drain pipe is prevented from flowing backwards.

The principle and structure of the water flowing detection device of the present embodiment are the same as the principle and structure of the water flowing detection device of the embodiment I, the water flowing detection device comprises a circuit board 321, guide rods, touch springs 323, a first plate electrode 324 and an insulating plate 325, similarity, in the water flowing detection device, the conductive panel 341 in the assembly of the surface cover 340 is used as a second plate electrode, and the water flowing condition of the floor drain 300 is detected by judging whether the first plate electrode 324 and the panel 341 are conducted through water. The structure, the assembling relation and the beneficial effects of the water flowing detection device of the present embodiment are shown in related descriptions about the water flowing detection device in the embodiment I, and the descriptions thereof are omitted herein.

In the present embodiment, both the first motor 317 and the second motor 344 are electrically connected with the control module of the water flowing detection device and are controlled by the water flowing detection device, and thus, the water flowing detection device controls the running of the electric hair cutting device 310 and the running of the surface cover 340 according to the water flowing condition of the floor drain 300.

Figure 19:
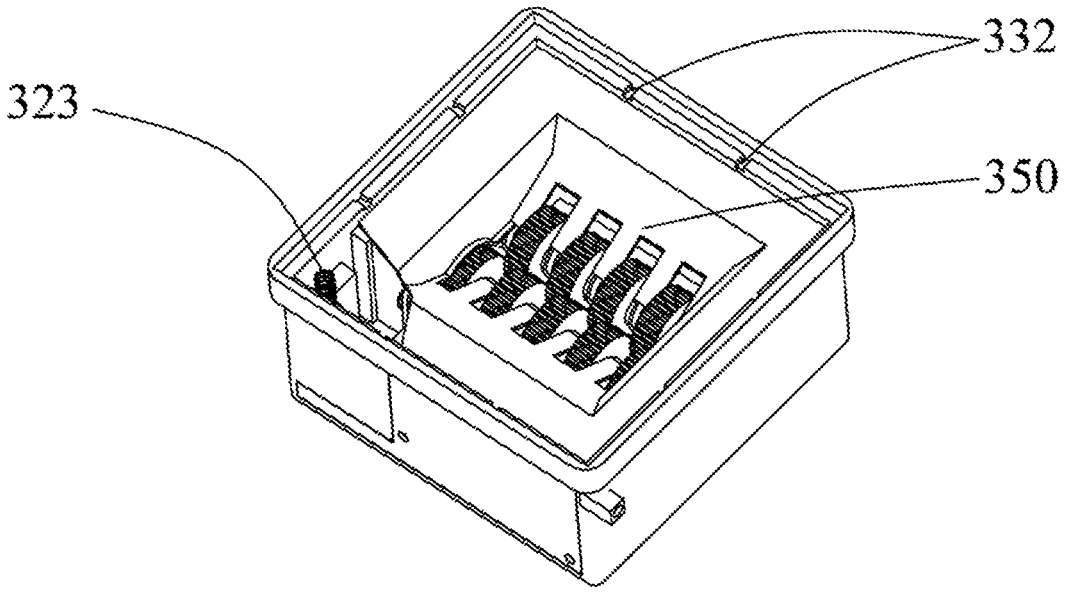
FIG. 19 is a three-dimensional view of the floor drain of which the surface cover is concealed in the embodiment III of the present invention.
Figure 20:
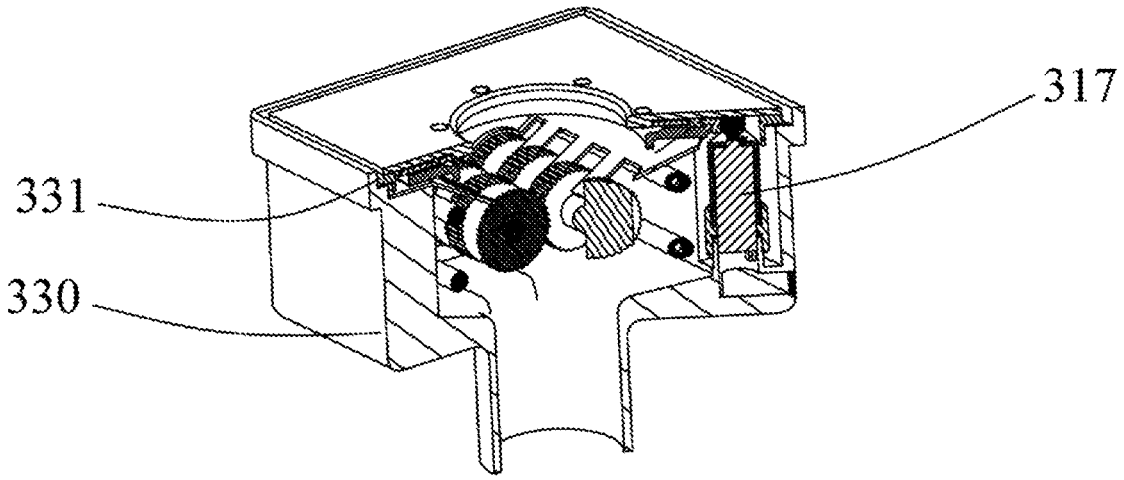
FIG. 20 is a cross-sectional view of the floor drain in the embodiment III of the present invention.

As shown in FIG. 19 and FIG. 20, the structures of the floor drain seat 330 and the grate 350 of the present embodiment are the same as the structures of the floor drain seat 130 and the grate 150 of the embodiment I. The floor drain seat 330 which is used as a floor drain main body guides water flow to enter the drainage pipe, and provides mounting space for the electric hair cutting device 310 and the water flowing detection device. After the first plate electrode 324, the insulating plate 325 and the surface cover 340 are assembled on the floor drain seat 330, a water accumulating groove 331 which surrounds the floor drain seat 330 is enclosed by the inner side wall of the floor drain seat 330, the first plate electrode 324 as well as side walls of the insulating plate 325 and the panel 341 jointly. In addition, the floor drain seat 330 is further provided with a water leaking groove 332, and the water leaking groove 332 communicates with the water accumulating groove 331 and a drain hole of the floor drain 300, so that accumulated water in the water accumulating groove 331 can be rapidly drained through the water leaking groove 332.

The floor drain 300 with the electric hair cutting function and the electric surface cover opening and closing function of the present embodiment is adopted, the electric hair cutting device 310 is assembled in the floor drain seat 330, the surface cover 340 is assembled on the floor drain seat 330, the water flowing detection device is further provided, and thus, running of the electric hair cutting device 310 and running of the surface cover 340 are automatically controlled according to the water flowing condition of the floor drain 300; when water on the ground flows to the inlet of the floor drain 300, the water enters the water accumulating groove 331 first, then the first plate electrode 324 and the panel 341 are conducted, the water flowing detection device controls the running of the first motor 317 to enable the electric hair cutting device 310 to run before the sundries enter the floor drain 300, the circumstance that the sundries which are not cut enter the drainage pipe is prevented, synchronously, the water flowing detection device controls the running of the second motor 344, the guide track plate 342 is driven to rotate to open the water flowing through holes in the panel 341 through the blades 343, and then the water drainage function of the floor drain 300 is fulfilled; and after the water on the ground is drained, the water in the water accumulating groove 331 is rapidly drained through the water leaking groove 332, conduction between the first plate electrode 324 and the panel 341 is disconnected, the water flowing detection device controls the first motor 317 to be closed so as to stop operation of the electric hair cutting device 310, the water flowing detection device further drives the second motor 344 to rotate reversely, the guide track plate 342 is driven to rotate reversely so as to close the water flowing through holes in the panel 341 through the blades 343, and thus, the water drainage function of the floor drain 300 stops.

The above descriptions about the specification and the embodiments are used for illustrating the scope of protection of the present invention, but do not constitute a limitation to the scope of protection of the present invention.

What is claimed is:

1. A hair cutting assembly, comprising:

at least one first shearing wheel of which an end surface is intersected with a side wall to form a first cutting blade;

a first transmission shaft, being connected with all of the first shearing wheels in a rotation-stopping manner;

at least one second shearing wheel of which an end surface is intersected with a side wall to form a second cutting blade; and a second transmission shaft, being connected with all of the second shearing wheels in a rotation-stopping manner;

the first shearing wheels and the second shearing wheels being arranged horizontally and being spaced from one another, and opposite end surfaces of each of the first shearing wheel and the corresponding second shearing wheel abutting each other; the first transmission shaft and the second transmission shaft being distributed in parallel, and being rotatably connected by an engaged gear set such that drives the first shearing wheels and the second shearing wheels rotating relatively, and the first cutting blades and the second cutting blades moving oppositely in a feed direction, wherein the hair cutting assembly further comprises elastic elements, the opposite end surfaces of each of the first shearing wheel and the corresponding second shearing wheel abuts each other in an elastic abutted manner through the elastic elements.

2. The hair cutting assembly according to claim 1, wherein the elastic elements are sleeved to the first transmission shaft and the second transmission shaft, and are respectively arranged on two sides of the first shearing wheels and two sides of the second shearing wheels.

3. The hair cutting assembly according to claim 1, wherein each of the first shearing wheels and/or each of the second shearing wheels comprises a first wheel plate and a second wheel plate; and each second wheel plate is axially nested to the corresponding first wheel plate, the elastic elements are sleeved to the first transmission shaft and/or the second transmission shaft, and each elastic element is arranged between the first wheel plate and the second wheel plate of the first shearing wheel or the first wheel plate and the second wheel plate of the second shearing wheel.

4. A floor drain, comprising a floor drain seat and a surface cover, wherein the floor drain further comprises a manual hair cutting device assembled in the floor drain seat;

the manual hair cutting device comprises the hair cutting assembly according to claim 1, a support and a first transmission assembly;

the support is configured for supporting the hair cutting assembly;

the first transmission assembly comprises a ratchet, an oscillating bar, a first pawl, a torsional spring and a second pawl; the ratchet is connected with the first transmission shaft in a rotation-stopping manner; the oscillating bar is hinged with the first transmission shaft; the first pawl is hinged with the oscillating bar, and drives the first transmission shaft to rotate with a one-way rotation of the oscillating bar; the torsional spring is sleeved to the first transmission shaft, and one end of the torsional spring is abutted to the support and the other end of the torsional spring is abutted to the oscillating bar to drive the oscillating bar and the first pawl to reset; the second pawl is hinged to the support to prevent rotation of the ratchet when the first pawl is reset; and through holes are formed in the surface cover correspondingly, and allow a driving piece to extend in so as to press the oscillating bar.

5. A floor drain, comprising a floor drain seat and a surface cover, wherein the floor drain further comprises an electric hair cutting device assembled in the floor drain seat;

the electric hair cutting device comprises the hair cutting assembly according to claim 1, a support, a first motor and a second transmission assembly;

the support is configured for supporting the hair cutting assembly;

the first motor is fixedly connected to the support;

one end of the second transmission assembly is connected to an output end of the first motor in a rotation-stopping manner, and the other end of the second transmission assembly is connected to the first transmission shaft in a rotation-stopping manner, wherein the second transmission assembly comprises a worm gear and a worm, and the worm gear and the worm are respectively connected to the first transmission shaft and the first motor in a rotation-stopping manner.

6. The floor drain according to claim 5, further comprising a grate, wherein the grate comprises an assembling part, a first blocking part and a second blocking part connected to each other, and the assembling part is configured for assembling the grate in the floor drain seat; the first blocking part, being inclined to the first shearing wheels and the second shearing wheels from the assembling part and inwards extending to stop hairs from dropping in a cavity of the floor drain seat from a gap between the inner side wall of the floor drain seat and the first shearing wheels or a gap between the inner side wall of the floor drain seat and the second shearing wheels; and the second blocking part, extending from the first blocking part to enter gaps among the adjacent first shearing wheels and gaps among the adjacent second shearing wheels to stop hairs from dropping in the cavity of the floor drain seat from the gaps among the adjacent first shearing wheels or the gaps among the adjacent second shearing wheels.

7. The floor drain according to claim 5, wherein the floor drain further comprises a water flowing detection device, the water flowing detection device comprises a detection module and a control module, the detection module generates a water flowing signal when water flows through the floor drain and transmits the water flowing signal to the control module; the control module transmits a control signal to the first motor to switch on the first motor after receiving the water flowing signal.

8. The floor drain according to claim 7, wherein the detection module comprises a first plate electrode, a second plate electrode and an insulating plate; the insulating plate is disposed between the first plate electrode and the second plate electrode; and when water flows through the floor drain, the first plate electrode and the second plate electrode are conducted through water, and the water flowing signal is generated.

9. The floor drain according to claim 8, wherein the first plate electrode and the second plate electrode are assembled on the floor drain seat, a water accumulating groove is enclosed by the first plate electrode, the second plate electrode and the inner side wall of the floor drain seat in a surrounding manner, and the first plate electrode and the second plate electrode communicate with each other in a conductive manner through accumulated water in the water accumulating groove.

10. The floor drain according to claim 8, wherein the detection module is provided with two guide rods, each guide rod is provided with a touch spring, and the two guide rods are respectively electrically connected with the first plate electrode and the second plate electrode through the touch springs in an elastic abutted manner.

11. The floor drain according to claim 7, wherein the surface cover comprises a panel, blades and a second motor, the panel is provided with water flowing through holes; the blades are pivotally connected to the panel and the blades are configured to open or close the water flowing through holes through rotating relative to the panel; and the second motor drives the blades to rotate relative to the panel.

12. The floor drain according to claim 11, wherein the second motor is electrically connected with the control module, and the control module transmits a control signal to the second motor to switch on the second motor after receiving the water flowing signal.

13. The floor drain according to claim 11, wherein the floor drain further comprises a guide track plate which is rotatably connected with the panel; the guide track plate is provided with a track groove; the blades are provided with guide columns which are slidably arranged in the track groove; and the second motor drives the guide track plate to rotate relative to the panel so as to drive the guide columns to slide along the track groove, such that the blades rotate around pivot shafts.

14. The floor drain according to claim 13, wherein the guide track plate is provided with ring teeth, and an output end of the second motor is provided with a gear which is engaged with the ring teeth so as to drive the guide track plate to rotate.

15. The floor drain according to claim 13, wherein the floor drain further comprises rotation-stopping structures, the rotation-stopping structures are formed respectively by a limiting protrusion of the panel and a limiting protrusion of the guide track plate, such that the guide track plate stops rotating at a position where the two limiting protrusions are abutted to each other.

* * * * *